US011857039B2

(12) United States Patent
Elam et al.

(10) Patent No.: US 11,857,039 B2
(45) Date of Patent: Jan. 2, 2024

(54) EARRING ALIGNER

(71) Applicants: Zia Elam, Damascus, MD (US); Jazmin Hernandez, Damascus, MD (US); Megan Lieberson, Damascus, MD (US); Jadzia Bennett, Damascus, MD (US); Keira Dempsey, Hagerstown, MD (US); Gabriella Janss, Damascus, MD (US)

(72) Inventors: Zia Elam, Damascus, MD (US); Jazmin Hernandez, Damascus, MD (US); Megan Lieberson, Damascus, MD (US); Jadzia Bennett, Damascus, MD (US); Keira Dempsey, Hagerstown, MD (US); Gabriella Janss, Damascus, MD (US)

( * ) Notice: Subject to any disclaimer, the term of this patent is extended or adjusted under 35 U.S.C. 154(b) by 343 days.

(21) Appl. No.: 17/399,664

(22) Filed: Aug. 11, 2021

(65) Prior Publication Data

US 2023/0052867 A1 Feb. 16, 2023

(51) Int. Cl.
*A44C 7/00* (2006.01)

(52) U.S. Cl.
CPC ..... *A44C 7/001* (2013.01); *A44C 7/003* (2013.01)

(58) Field of Classification Search
CPC ..... A44C 7/003; A44C 7/001; A44C 7/004; A44C 7/006; A44C 7/007; A61B 17/3415
See application file for complete search history.

(56) References Cited

U.S. PATENT DOCUMENTS

| | | | | | |
|---|---|---|---|---|---|
| 234,881 | A * | 11/1880 | McAlpine | A44C 7/001 | 606/188 |
| 511,952 | A * | 1/1894 | Hubash | A44C 7/001 | 63/14.7 |
| 2,769,322 | A * | 11/1956 | Czuch | A44C 7/00 | D11/75 |
| 3,901,243 | A * | 8/1975 | Read | A44C 7/001 | 227/147 |
| 5,263,968 | A * | 11/1993 | Sorensen | A61B 17/076 | 294/99.2 |
| 5,421,629 | A | 6/1995 | Karban | | |
| 5,465,593 | A * | 11/1995 | Takasu | A44C 7/003 | 63/12 |
| 9,392,849 | B1 * | 7/2016 | Makhoulian | A44C 7/003 | |
| 10,849,393 | B2 | 12/2020 | Shapiro | | |

(Continued)

FOREIGN PATENT DOCUMENTS

| | | | | |
|---|---|---|---|---|
| KR | 100321249 B1 * | 10/2001 | | A44C 7/00 |
| KR | 20220002994 U * | 12/2022 | | A44C 7/003 |

*Primary Examiner* — Emily M Morgan
(74) *Attorney, Agent, or Firm* — Xsensus LLP

(57) ABSTRACT

An earring aligner system includes an earring aligner, which has a front arm and a back arm, as well as a hinge that rotationally connects a first end of the front arm to the back arm. A second front segment of the front arm includes an earring support with a post receiver void that is sized to detachably hold a post of an earring therein. A second back segment of the back arm includes at least three prongs that are spaced to support an earring back therebetween. The hinge is operable to change a hinge angle from a larger angle between the front arm and back arm during earring mounting on the earring aligner to a smaller angle during alignment of the earring post with the earring back after the earring post is inserted through a hole in an earlobe of a user.

5 Claims, 7 Drawing Sheets

(56) References Cited

U.S. PATENT DOCUMENTS

| | | | | |
|---|---|---|---|---|
| 2007/0089455 | A1 | 4/2007 | Garvin | |
| 2007/0151294 | A1* | 7/2007 | Williams | A44C 7/003 63/12 |
| 2013/0298603 | A1 | 11/2013 | Baik | |
| 2019/0246751 | A1* | 8/2019 | Tannen | A44C 7/002 |
| 2020/0214404 | A1* | 7/2020 | Andrews | A44C 7/003 |
| 2023/0106776 | A1* | 4/2023 | Bonutti | A44C 7/003 2/455 |

* cited by examiner

EARRING ALIGNER

BACKGROUND

Technical Field

The present disclosure relates to a system and device for assisting a user align an earring back to an earring post though a person's pierced ear.

Discussion of Background

Conventionally, to attach an earring through their pierced ear, a person inserts a post of an earring through their piercing (a hole in their earlobe), and then secures the earring with a second piece, called a "back". For the most common types of earrings, the back has an opening in it that is sized to receive the post therein, and the back holds the post in place by a compressive force applied against the post. Other earrings use a threaded post, and the back has a threaded opening into with the post is secured by screwing the threading opening around the threads on the post.

While many users simply use their fingers to attach the back to the earring post, there is a conventional device, named Little Fingers Earing Helper, that is pliers-like and helps a user maintain a better grip on the earring and backing. The Little Fingers Earring Helper consists of a 3.5-inch-long plastic wand which holds an earring back but does nothing to assist with alignment or assembly.

SUMMARY

According to an aspect of the present disclosure, a new earring aligner system is described that includes an earring aligner, which has a front arm and a back arm, as well as a hinge that rotationally connects a first end of the front arm to the back arm. A second front segment of the front arm includes an earring support with a post receiver void that is sized to detachably hold a post of an earring therein. A second back segment of the back arm includes at least three prongs that are spaced to support an earring back therebetween. The hinge is operable to change a hinge angle from a larger angle between the front arm and back arm during earring mounting on the earring aligner to a smaller angle during alignment of the earring post with the earring back after the earring post is inserted through a hole in an earlobe of a user.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

As recognized by the present inventors, who at the time of this writing are members of a girl scout troop, there are no devices on the market that assist people who have just had their ears pierced with aligning the earring post to the opening in the earring back. Assembling an earring can be frustrating for beginners because it requires some manual dexterity and tactile agility to "feel" where the opening of the back is located with respect to the tip of the earring post. Not only is it frustrating for novices, but it may even be more frustrating for people who have worn earrings for years, but, often due to their age, have lost some flexibility and feel in their fingers. Of course, such people could stop wearing their pierced earrings and using clip-ons or other alternatives, but they may already have a large collection of conventional earrings that would otherwise go wasted if they abandoned their present jewelry collection for alternative designs. Also, jewelry can be of great sentimental value, and so the present inventors recognized a need for a device that helps novices, and experienced people alike, align and assemble their pierced earrings in a way that avoids frustration, while preserving their independence when putting on their favorite jewelry accessories.

Figure 1:
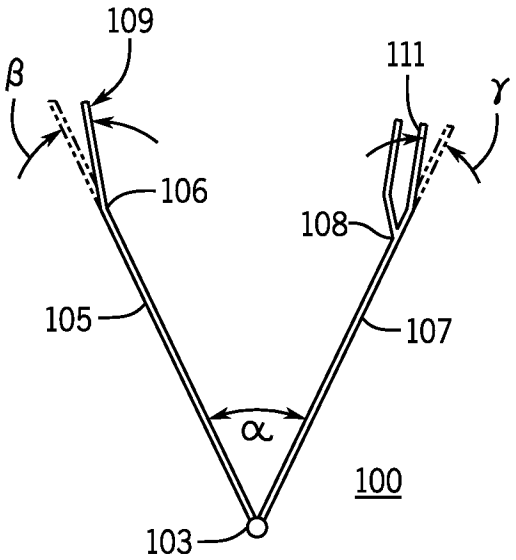
FIG. 1 is a side-view of a hinged earring aligner.
Figure 2:
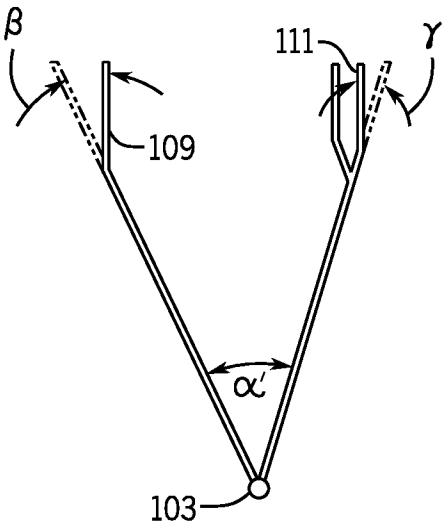
FIG. 2 is another side-view of the hinged earring aligner with respective legs of hinged earring aligner closer together than in FIG. 1.
Figure 3:
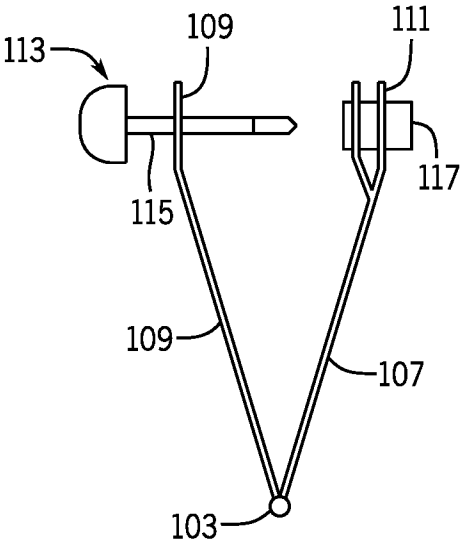
FIG. 3 is a side-view of the hinged earring aligner that is holding an earring and an earring back.

FIGS. 1-6 are a series of views of a hinged aligner 100 that assist a user in connecting an earring post 115 (as shown in FIG. 3) to an earring back 117 (also shown in FIG. 3). The hinged aligner 100 enables a user to attach their existing earrings to their earlobes without the sometimes challenging effort of using their tactile sensation to mount the post 115 to the earring back 117. This also helps people with arthritis or other physical limitations that limit their fine motor skills required to attach an earring to their ear. Furthermore, hinged aligner 100 helps people who may not be accustomed to attaching an earring to their ear, such as younger people who may have just had their ears pierced.

FIG. 1 is a side-view of the hinged aligner 100. The hinged aligner 100 includes a front arm 105 with a front bend 106, which is bent relative to the front arm at an angle β. The amount of bend in an inclusive range of 0-2 degrees. The hinged aligner 100 also includes a back arm 107 with a back bend 108. The back bend 108 is bent at another angle γ, that is in an inclusive range of 3 to 8 degrees. The two arms, 105 and 107 are rotatably attached by a hinge 103. In this embodiment, with the hinge open and not biased by an external force, the front arm 105 and the back arm 107 form roughly a 35-degree angle α. The angle α can be between 90 degrees and 10 degrees in this example. The front bend 106 and back bend 108 are portions of the respective arms that bend towards each other. In this embodiment, the front arm 105, back arm 107, and hinge 103 are made from aluminum, although other metals may be used, or plastic with a resilient connected portion that serves as the hinge 103. The front arm 105 and back arm 107 are around 1 inch in length, with an earring support 109 attached to the front arm 105 about 0.25 inches away from the top of the front arm 105, and a back support 111 attached to the back arm 107 around 0.25 inches away from the top of the back arm 107.

The bends are present because the arms move in an arc and, unless the bends were in place, the post 115 would remain misaligned with the back 117 even as the angle α narrows. The front prongs 501 and back prongs 506 hold the back 117 until the post 115 enters an opening in the back 117. The insertion of the post 117 into the opening of the back 118 causes the back 117 to lift off the back prongs 506 while the post 115 remains attached to the hinged aligner 100 with the support 109.

FIG. 2 is a side view of the hinged aligner with a narrower angle α', which is smaller than a as shown in FIG. 1. FIG. 2 also shows an earring support 109 attached to the front arm 105. The front bend 106 and back bend 108 are angled so that when the front arm 105 and back arm 107 are brought together with the hinge 103, so a main axis of the post 115 is aligned with the hole of the back 117, the post 115 enters the hole of the back 117 without obstruction.

FIG. 3 is a side view of the hinged aligner 100, with an earring 113 and a back 117 respectively placed into the earring support 109 and back support 111. The post 115 of the earring 113 fits into the earring support 109, as will be discussed in more detail with respect to FIG. 4. The earring support 109 is formed at a 0 to 2-degree angle by the front bend 106 at the end of the front arm 105. The back support 111 is formed at a 3 to 8-degree angle by the back bend 108 at the end of the back arm 107. The front arm 105 and the back arm 107 are attached to the hinge 103 at a 35-degree angle.

Figure 4:
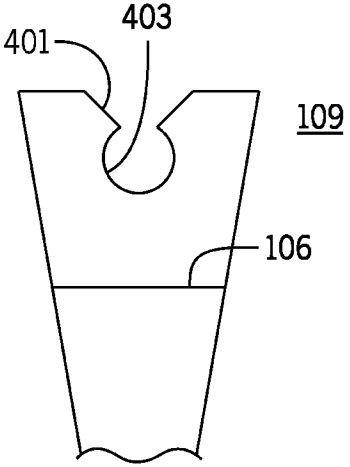
FIG. 4 is a front-view of an earring post holder of the hinged earring aligner of the first embodiment.

FIG. 4 is a front view of the earring support 109. In this embodiment the earring support 109 is made of resilient metal and is attached to the front bend 106 of the front arm 105. The facet guide 401 holds the post 115 in place by physically pinning the post 115 in the post receiver 403. In one embodiment, the facet guide 401 is made from aluminum or another flexible metal, or preformed plastic and is angled to allow the post 115 to slide into the into the post receiver 403. However, in another embodiment, the earring support is larger in dimension and is fitted with a foam glove that is placed over the post receiver 401 and has a similar shape to the post 401, including the post receiver 403. However, the foam glove itself is a pliable and resilient material such that when the post is placed in the post receiver portion of the foam glove, the post is held in place by a compressive force of the foam against the periphery of the post, which in turn pins the post 115 inside the post receiver portion of the foam glove. When the foam glove is used, it is not necessary for the earring support 109 to be made of resilient metal because the post can easily be removed from the post receiver portion of the foam glove by the user exerting a larger extraction force on the earring post than the compressive force exerted on the post by the foam glove.

Figure 5:
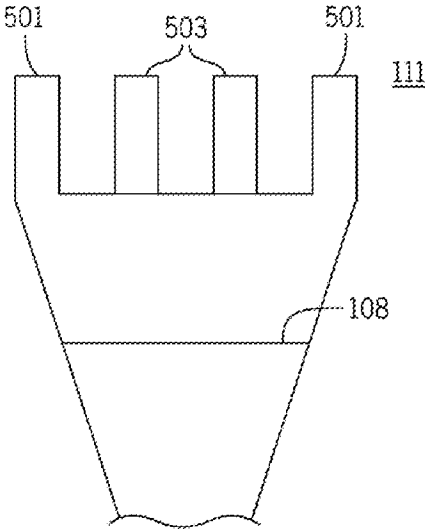
FIG. 5 is a front-view of an earring back holder of the hinged earring aligner of the first embodiment.

FIG. 5 is a front view of the back support 111. The back support 111 connects to the back bend 108 and has two sets of prongs. The first set of prongs is a pair of front prongs 503, and the second set is a pair of back prongs 501. The front prongs 503 hold the front of the earring back 117, while the back prong 501 set holds the back of the earring back 117. The back 117 is held within the back support 111 by gravity, although the back 117 may be press-fit within the prongs 501/503. Once the post 115 is inserted into the back 117, the narrowing of the angle α will simultaneously further insert the post 115 into the receiver in the back 117 while lifting the back 117 off of the prongs of the back support 111 until the back 117 disengages from the back support 111. In another embodiment, the prongs are longer than the amount of lift imparted by the post 115, and so the user can disengage the back support 111 from the back by pulling the hinged aligner 100 in a downward manner. The pulling down of the hinged aligner 100 also forces the post 115 to be laterally removed (i.e., the post 115 radially exits the open portion of the post receiver 403) from the post receiver 403 (FIG. 4) so as to disengage the earring 113 from the earring support 109 on the front side of the user's ear.

Figure 6:
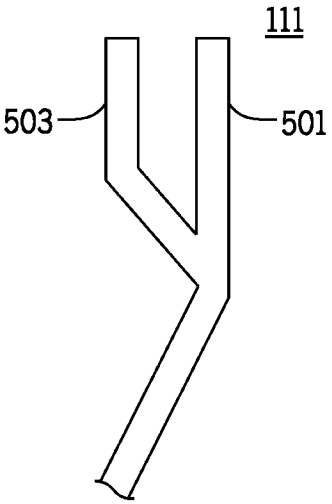
FIG. 6 is a side-view of the earring back holder of the hinged earring aligner of the first embodiment.
Figure 8:
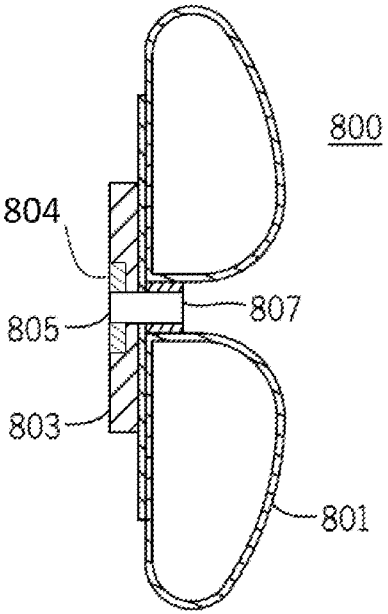
FIG. 8 is a cross-section of an earring back including magnetic features.
Figure 7:
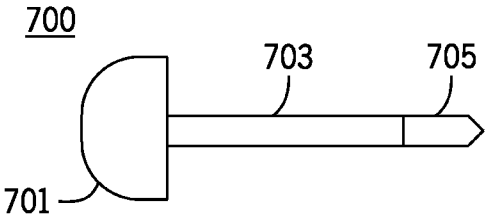
FIG. 7 is a side-view of an earring post including a magnetic tip that may be aligned with the hinged aligner of FIG. 1, or other aligners disclosed herein.

FIG. 6 is a side view of the back support 111. The front prong 503 set and back prong 501 set have a gap between them to allow for the back 117 to fit between the two sets of prongs. The hinged aligner 100 enables a user to put earrings in their ears without needing to waste time feeling around for the post 703 with the earring back 117. This also helps people with arthritis or other physical limitations that would prevent the fine motor skills required to put earrings in from being used put earrings in their ears FIG. 7 is a side view of a magnetized earring 700 that may be used with any of the aligner embodiments disclosed herein. The magnetized earring 700 includes an earring forward face 701 that has a post 703 attached thereto. The post 703 has a tip with a magnetized post segment 705 disposed at an end of the post 703, FIG. 8 is a cross-section of a magnetized back 800 that attaches to the earring 700 of FIG. 7. The magnetized back 800 is secured tightly to the post 703 in order to remain on the user's ear. An opening 805 of the magnetized back 800 is surrounded by a magnetic ring 803 (also see FIG. 9). The magnetic ring 803 is made of a magnetic material having a same polarity as the magnetic material in the post segment 705. This matching of polarities is done purposefully so the post segment 705 will experience repulsive forces from the magnetic ring 803, where the repulsive forces are least at the center of the ring. Moreover, because the same polarities will repel the magnetized post segment 705 from moving radially toward the magnetic ring 803, the magnetic forces will keep the tip of the magnetized post segment 705 at a center axis of the ring, and thus help guide the magnetized post segment 705 into the opening 805. Once the post segment 705 approaches the opening of the back 805, it will also be magnetically attracted to the magnetic section 807 that is located directly behind the opening 805 and between the spring loop 801 of the back. The magnetic section 807 has an opposite polarity of the post segment 705 so the magnetic section 807 attracts the post segment 705 toward it, to facilitate insertion of the post 703 into the opening 805. The attractive magnetic forces from the opposite polarities will allow the post segment 705 to efficiently connect to the magnetic section 807 of the magnetized back 800. Once they are connected, the user can then use the spring loop 801 to further securely push or twist the back onto the post 703.

Figure 9:
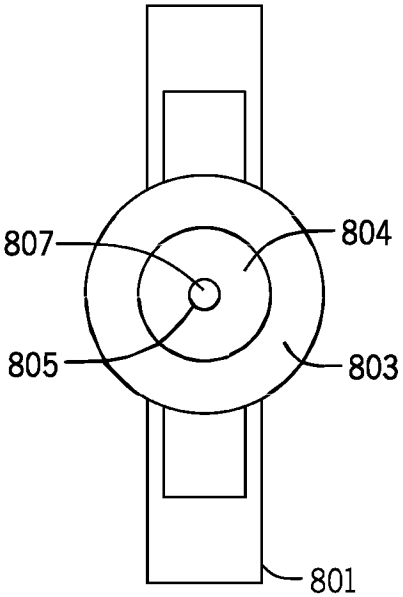
FIG. 9 is a front-view of an earring back that includes magnetic materials.

FIG. 9 is a front view of the magnetized back 800. As shown, there is a nonmagnetic ring 804 that serves as a buffer region so the magnetic ring 803 is sufficiently spaced from the opening 805. Moreover, if the magnetic ring 803 were too close to the opening 805 without the non-magnetic ring 804, the magnetized post segment 705 may be magnetically urged radially away from the opening 805. On the other hand, by having the non-magnetic 804 coaxially located withing the magnetic ring 803, the translation motion of the magnetized post segment 705 into the opening 805 is not substantially resisted while repulsive forces from the magnetic ring 803 tend to center the magnetized post segment toward the centroid for the magnetic ring 803 because the repulsive forces from the magnetic ring 803 are weakest at its center.

Figure 10:
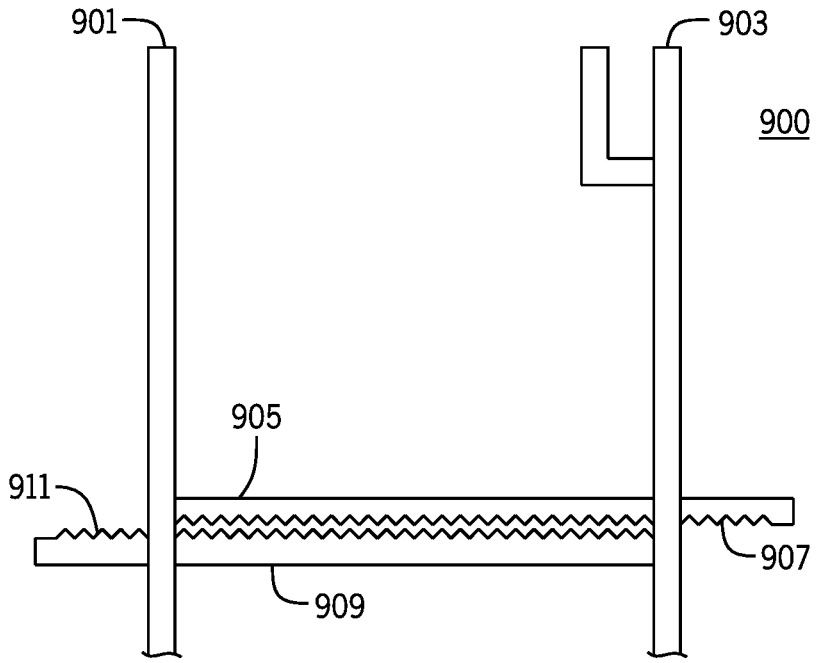
FIG. 10 is a side-view of a rail-based earring aligner according to another embodiment.

FIG. 10 is a side-view of slide aligner 900 for connecting an earring in one's ear to an earring back. The slide aligner 900 includes a forward arm 901, a rear arm 903, a forward serrated arm 905, a rear serrated arm 907, and serrations 909/911 on both the forward serrated arm 905 and the rear serrated arm 907. In other embodiments the serrations are replaced with nubs that slide over one another, or the surfaces may be smooth as well. The forward arm 901 is attached to the forward serrated arm 905 near the front of the forward serrated arm 905. The rear arm 903 is attached to the rear serrated arm 907 near the back of the rear serrated arm 907. The serrations 909/911 on the forward serrated arm 905 and rear serrated arm 907 enable the forward serrated arm 905 and the rear serrated arm 907 to engaged while they slide across each other precisely so that the rear arm 903 and forward arm 901 controllably come together. Therefore, when the post 703 is placed in the forward arm 901 and the back 117 is put into the rear arm 903, the back 117 attaches to the post 703 adjacent to the user's ear. This enables people to attach earrings to their ears fumbling while attempting to insert the post 703 in the earring back 117. This also helps people with arthritis or other physical limitations that would prevent the fine motor skills required to put earrings in from being used put earrings in their ears.

Figure 11:
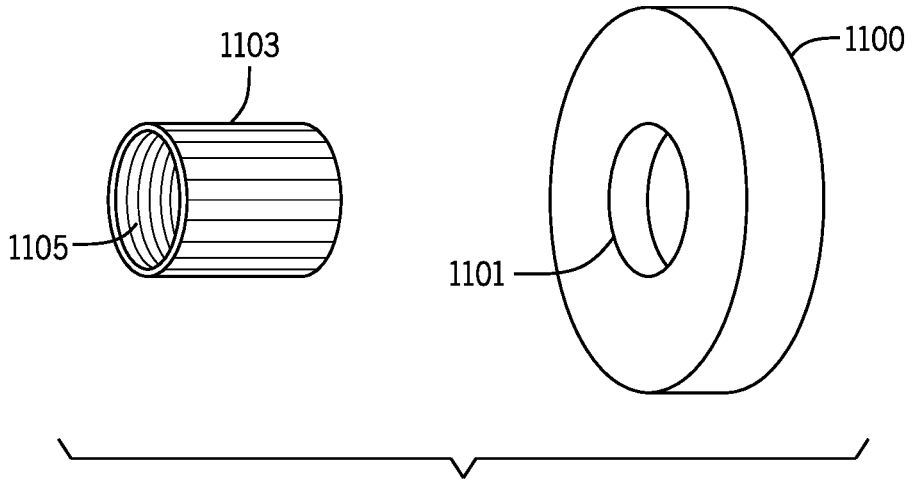
FIG. 11 is a perspective view of a twist tool and an earring back that twists onto a threaded earing post.

FIG. 11 is a perspective view of two devices that cooperate with one another; one of which is composed of plastic in the shape of a ring, also are referred to as a twist tool 1100. In the twist tool 1100, there is a smaller hole in its center, also known as the twist receiver 1101. The twist receiver 1101 holds the back of the earring 1103, which has a ridged surface, to help keep it in place when inserted in the center of the twist tool. Moreover, the ridges 1103 help to retain the back 1103 inside of the twist tool 1100. In addition, there are threads formed in the interior of the back 1103, also known as the internal threads 1105. The internal threads 1105 match threads formed on a threated post. Once the back of the earring 1103 is placed securely in the twist receiver 1101, the user can use the Twist Tool 1100 to screw, twist, or push the earring back onto the post. This is beneficial for users with arthritis who cannot normally handle an earring back due to its smaller size.

Figure 12:
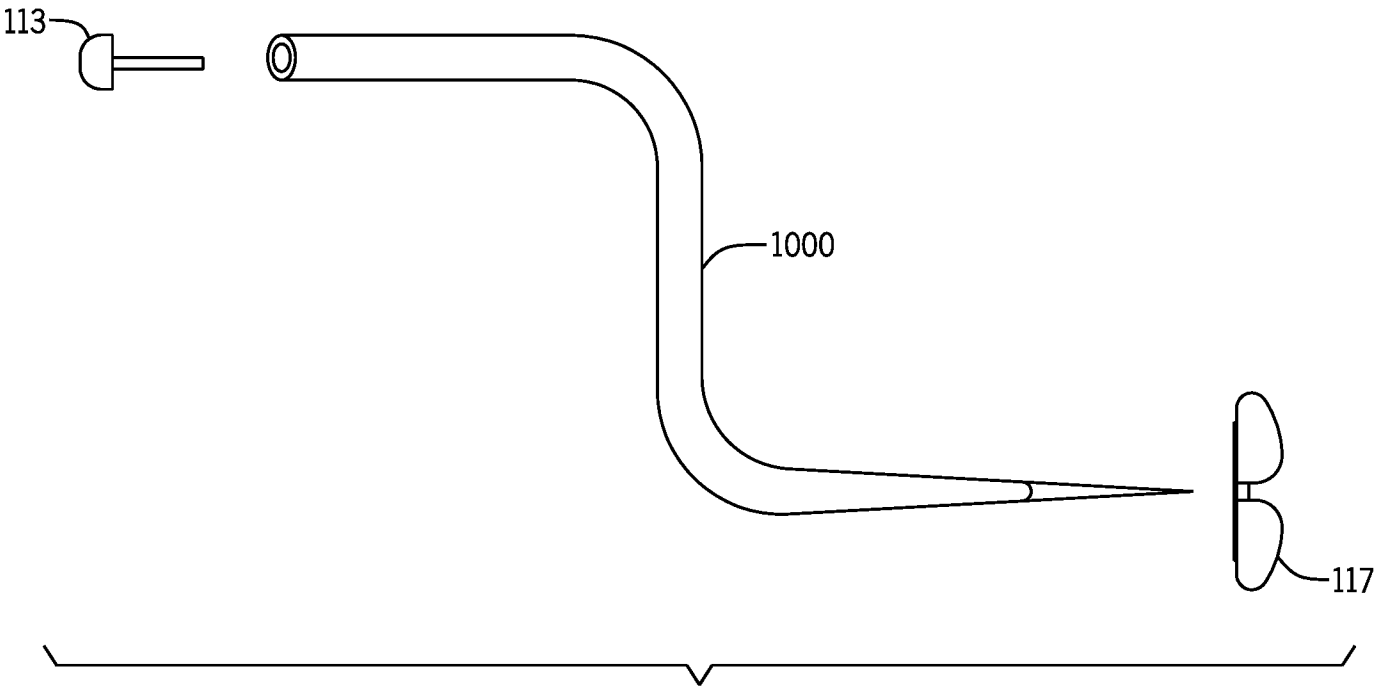
FIG. 12 is a side view of a strand aligner according to another embodiment.

FIG. 12 is a side view of a strand aligner 1000, according to another embodiment, which includes a heat shrinking material formed as a tube. The strand aligner 1000 is made from thin-walled (e.g., 6 mm to 0.05 mm, such as 1 mm) thermoplastic material, such as polyolefin, PTFE (polytetrafluoroethylene), PVC (polyvinyl chloride), silicon rubber, FEP (fluorinated ethylene propylene) or VITON. When exposed to a heat source (e.g., lighter or heat gun), the tubing shrinks in diameter so it may form a thin coating around an outer surface of the earring post, and adhere the strand to the post. Optionally, the device comes with an additional heat gun that is used to shrink the strand aligner 1000.

In this system, the earring post 115 is pushed into an open end of the strand aligner 1000. The user can then hold the earring 113 in front of them while applying heat to the portion of the tubing that covers the post of the earring post 115. In a reaction to the heat, the tubing closes around the post 115 and tubing grasps the post 115, thus connecting the strand aligner 1000 to the post 115 of the earring 113. This attachment can be accomplished with the user holding the earring in front of themselves, which may be very useful for someone who is not yet skilled at inserting an earring directly into their ear, or someone who may lack the manual dexterity to reliably insert the earring into their ear.

The other end of the strand aligner 1000 is pre-shrunken into a taper. This pre-shrunken end may further be coated with a substance (e.g., wax, or pliable plastic) that adds some stiffness to the end such as an aglet on a shoelace. This permits the user to insert the preshrunk end into front of the hole in their pierced ear, and then pull the tapered end from the back of their ear so as to urge the strand aligner 1000 through their ear and thus draw the post 115 into the hole in their earlobe.

Once the post is in the user's earlobe, most of the strand aligner 1000 will dangle for a majority of its length (e.g., about 1 foot) behind the user's ear. The user can then thread the earring back 117 over the preshrunk end of the strand aligner 1000. Once on the strand aligner 1000, the user can then slide the earring back 117 over the pliable stand aligner, 1000 until the earring back 117 reaches the post 115 and is inserted around the post 115 so as to hold the earring 113 in the user's ear. Once the back 117 is secured to the post 115, a long segment of the strand aligner 1000 remains dangling behind the earring back 117. The user can remove this segment by cutting it with scissors, or snipping it off with their fingernails.

An advantage of the strand aligner 1000 is that it allows the user to be able to hold the earring in front of them when inserting the string aligner 1000 to the post, and also see the earring back when inserting the strand aligner through the hole in the earring back. Similar to how a bead slides along a string, the back is guided directly to the post so the user can easily insert the back on the post even if the user is unaccustomed to the conventional way of putting a back on an earring post, or of the user lacks some manual dexterity to be able to align the back to the post.

Figure 13:
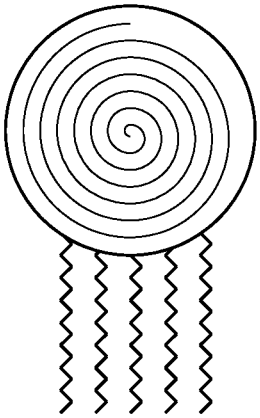
FIG. 13 is an earring front having an ornamental design of a dreamcatcher.

FIG. 13 is an earring front having an ornamental design of a dreamcatcher.

Figure 14:
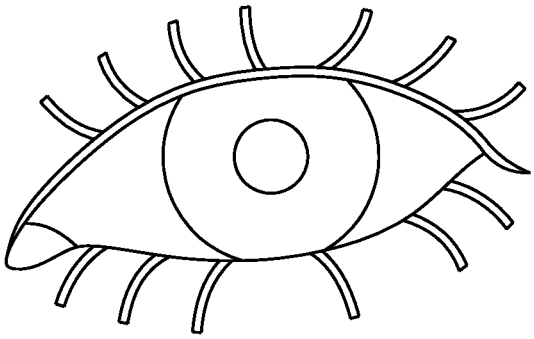
FIG. 14 is an earring front having an ornamental design of a realistic eye.

FIG. 14 is an earring front having an ornamental design of a realistic eye.

Figure 15:
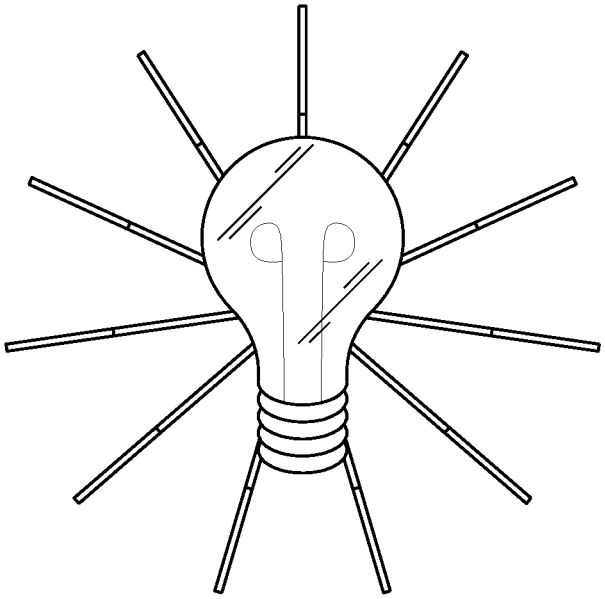
FIG. 15 is an earring front having an ornamental design of a lightbulb.

FIG. 15 is an earring front having an ornamental design of a lightbulb.

Figure 16:
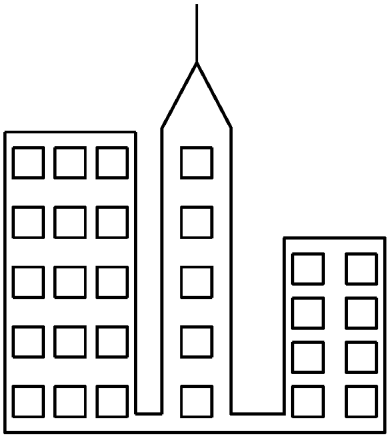
FIG. 16 is an earring front having an ornamental design of a cityscape.

FIG. 16 is an earring front having an ornamental design of a cityscape.

Figure 17:
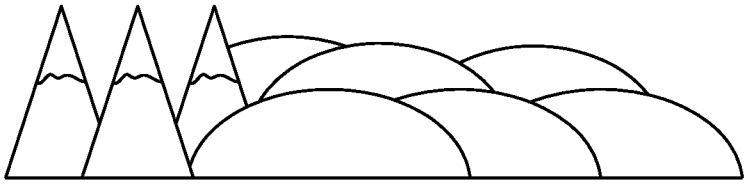
FIG. 17 is an earring front having an ornamental design of a mountain range.

FIG. 17 is an earring front having an ornamental design of a mountain range.

Figure 18:
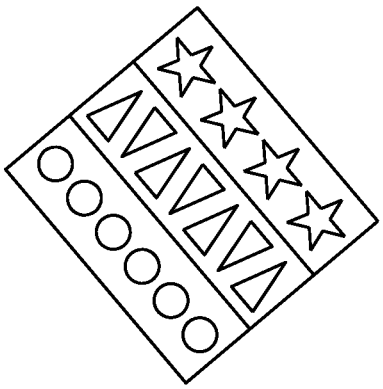
FIG. 18 is an earring front having an ornamental design with a variety of symbols on three rows.

FIG. 18 is an earring front having an ornamental design with a variety of symbols on three rows.

Figure 19:
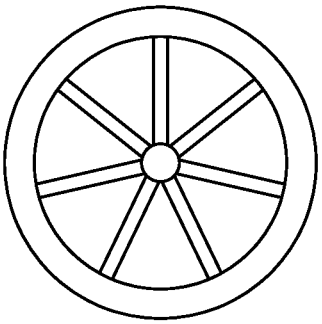
FIG. 19 is an earring front having an ornamental design of a wooden wheel.

FIG. 19 is an earring front having an ornamental design of a wooden wheel.

LIST OF ELEMENTS

100: Hinged Aligner
103: Hinge
105: Front arm

106 Front bend
107 Back arm
108 Back bend
109 Earring support
111 Back support
113 Earring
115 Post
117 Back
401 Facet Guide
403 Post Receiver
501 Back prong
503 Front prong
700 Magnetized Earring
701 Earring forward face
703 Post
705 Magnetized Post Segment
800 Magnetized Back
801 Spring Loop
803 Magnetic Ring
804 Non-magnetic ring
805 Opening
807 Magnetic Section
900 Slide Aligner
901 Forward arm
903 Rear arm
905 Forward serrated arm
907 Rear serrated arm
909/911 serrations
1000 Strand aligner
1100 Twist tool
1101 Twist receiver
1103 Back with ridges
1105 Internal Thread Obviously, numerous modifications and variations of the present disclosure are possible in light of the above teachings. It is therefore to be understood that within the scope of the appended claims, the disclosure may be practiced otherwise than as specifically described herein.

The invention claimed is:

1. An earring aligner system comprising:

an earring having an earring post with a magnetized post segment at an end thereof, the magnetized post segment having a predetermined polarity, an earring back, an earring aligner including a front arm having a first front segment that is substantially straight, and a second front segment that is bent at a first predetermined angle relative to the first segment, a back arm having a first back segment that is substantially straight, and a second back segment that is bent at a second predetermined angle relative to first back segment, and a hinge that rotationally connects a first end of the first front segment of the front arm to a first end of the first back segment of the back arm, wherein the second front segment of the front arm includes an earring support with a post receiver void that is sized to detachably hold the post of the earring therein, the second back segment of the back arm includes at least three prongs that are spaced to support the earring back therebetween, the hinge being operable to change a hinge angle from a larger angle between the front arm and back arm during earring mounting on the earring aligner to a smaller angle during alignment of the earring post with the earring back after the earring post is inserted through a hole in an earlobe of a user, the smaller angle corresponding to a position where a tip of the earring post enters the opening in the earring back, the opening in the earring back including a magnetic section that closes a back of the opening, and the magnetic section have an opposite polarity to the predetermined polarity so the magnetic section and the magnetized post segment experience an attractive force that tends to urge the earring post into the opening as the hinge is moved from the larger angle to the smaller angle and the position of the tip of the earring post approaches the opening, the earring back includes a face, and from a plan view of the face the earring back has a non-magnetic ring in a coaxial relationship with an outer magnetic ring and the opening, the opening being coaxially within a center of the no-magnetic ring, and the outer magnetic ring having a same polarity as the predetermined magnetic section such that as the magnetized post segment approaches the opening as the angle of the hinge approaches the smaller angle, a repulsive force tends to urge the magnetized post segment toward an axis that is aligned with the opening at a center of the face of the earring back.

2. The earring aligner system of claim 1, wherein the front arm and the back arm are metal, and the hinge is a mechanical hinge formed from respective knuckles disposed on ends of the first front segment of front arm and the first back segment of the back arm, the hinge includes a pin that is received by the respective knuckles.

3. The earring aligner system of claim 1, wherein the front arm, the back arm, and the hinge are plastic and the hinge, is a portion of plastic that forms the hinge is flexible and interconnects the front arm to the back arm.

4. The earring aligner system of claim 1, wherein the earring back includes a pair of spring loops that are on opposites sides of the earring post when the earring post is inserted into the opening and exerts a compressive force on the earring post so as to secure the earring post within the opening of the earring back.

5. An earring aligner system comprising:

an earring aligner including a front arm having a first front segment that is substantially straight, and a second front segment that is bent at a first predetermined angle relative to the first segment, a back arm having a first back segment that is substantially straight, and a second back segment that is bent at a second predetermined angle relative to first back segment, and a hinge that rotationally connects a first end of the first front segment of the front arm to a first end of the first back segment of the back arm, wherein the second front segment of the front arm includes an earring support with a post receiver void that is sized to detachably hold a post of an earring therein, the second back segment of the back arm includes at least three prongs that are spaced to support an earring back therebetween, the hinge being operable to change a hinge angle from a larger angle between the front arm and back arm during earring mounting on the earring aligner to a smaller angle during alignment of the earring post with the earring back after the earring post is inserted through a hole in an earlobe of a user, the smaller angle corresponding to a position where a tip of the earring post enters an opening in the earring back, the earring support of the front arm is made of a resilient metal with the post receiver void being of an arcuate shape of at least 180 degrees and having an open portion in which the earring post is removed after the earring is attached to the earlobe of the user and secured with the back, a downward force applied to the earring aligner causes the open portion to expand and permit the earring post to be laterally released from the post receiver void, and the at least three prongs consist of four prongs arranged in two offset rows, and the downward force of the earring aligner frees the earring back from the prongs.

* * * * *